United States Patent [19]

Gartung

[11] 4,185,430

[45] Jan. 29, 1980

[54] INTERCONNECTING MODULAR SCREEN ASSEMBLY

[75] Inventor: Clifford W. Gartung, Newport Beach, Calif.

[73] Assignee: Pleion Corporation, Santa Ana, Calif.

[21] Appl. No.: 902,731

[22] Filed: May 3, 1978

[51] Int. Cl.[2] ..... E04B 1/82; E04C 2/38

[52] U.S. Cl. ..... 52/285; 52/239; 52/288; 52/582

[58] Field of Search ..... 52/239, 238, 284, 285, 52/287, 288, 278, 582

[56] References Cited

U.S. PATENT DOCUMENTS

| | | | |
|---|---|---|---|
| 860,150 | 7/1907 | Plym | 52/282 |
| 1,300,722 | 4/1919 | Gray | 160/135 X |
| 2,202,861 | 6/1940 | Mills | 52/282 |
| 3,350,828 | 11/1967 | Russell | 52/282 X |
| 3,428,108 | 2/1969 | Singer | 52/239 X |
| 3,766,696 | 10/1973 | Totoonchie | 52/241 |
| 3,768,222 | 10/1973 | Birum, Jr. | 52/239 |
| 3,934,382 | 1/1976 | Gartung | 52/241 X |
| 4,085,789 | 4/1978 | Steiner et al. | 160/135 |

FOREIGN PATENT DOCUMENTS

| | | | |
|---|---|---|---|
| 1812442 | 6/1970 | Fed. Rep. of Germany | 160/135 |
| 1270034 | 7/1961 | France | 52/585 |

*Primary Examiner*—Alfred C. Perham

*Attorney, Agent, or Firm*—Jackson, Jones & Price

[57] ABSTRACT

A modular office screen assembly having a plurality of hollow rigid frame members supporting central panel members is disclosed. Each frame is constructed from horizontal and vertical channel shaped frame sections. An aperture is provided in an upper horizontal frame section of each frame member at the juncture of the horizontal and vertical sections. An L shaped support plate is rigidly mounted within the horizontal and vertical sections. Fastener members of various shapes and capable of lying in the same plane as the surface of the vertical sections are adapted for interconnecting at least two modular screens in predetermined partition configurations. Each fastener member includes a base plate and at least two male channel members, one male channel member being inserted in each aperture provided in the respective frames. The fastener members are supported by the L shaped support plates and lie flush with the outer peripheries of the assembled, interconnected modular screens.

15 Claims, 6 Drawing Figures

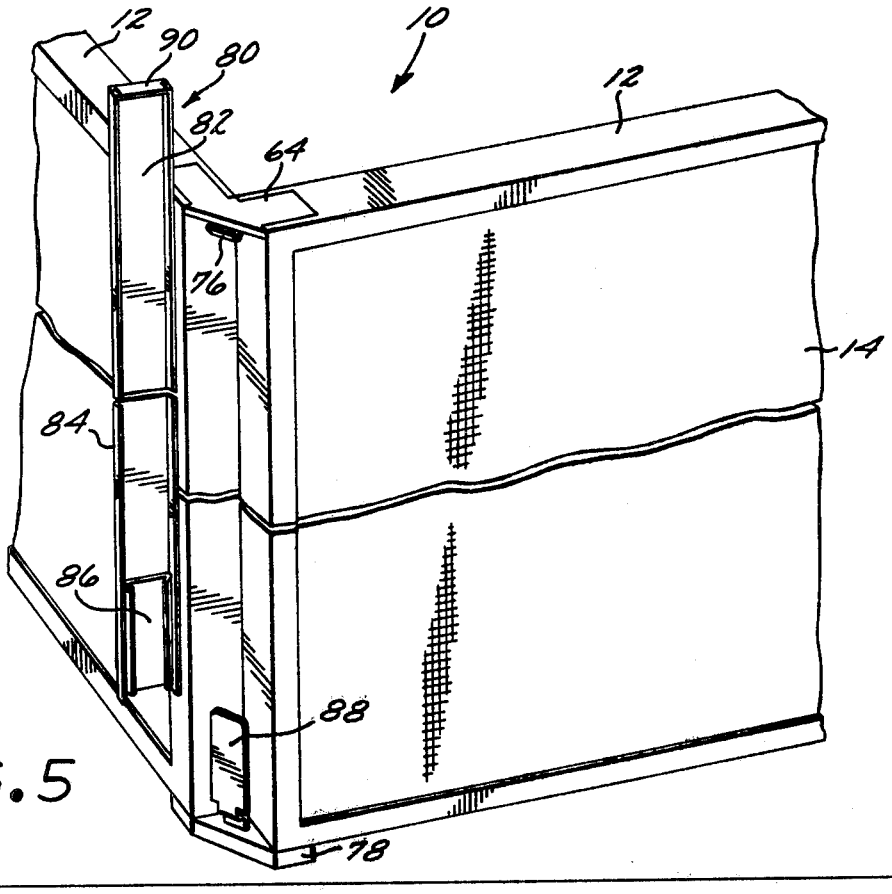
FIG. 5
FIG. 6
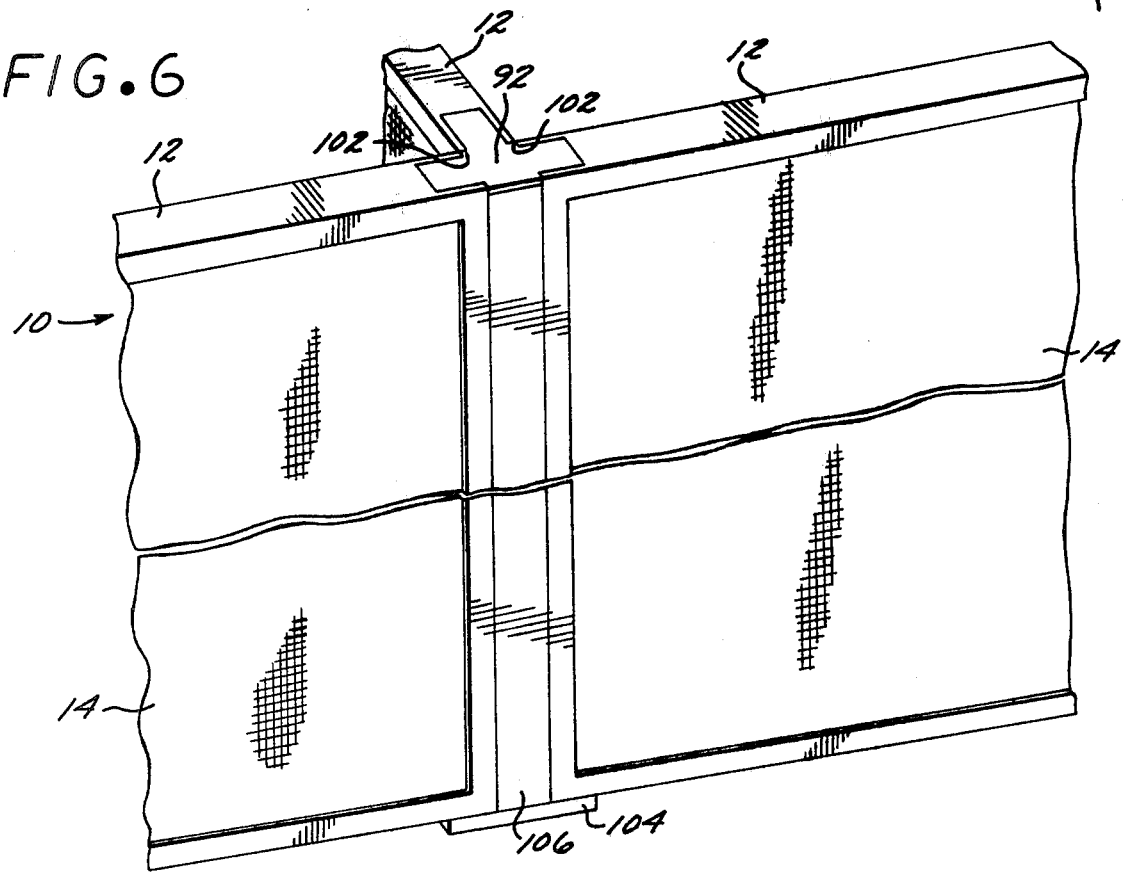

INTERCONNECTING MODULAR SCREEN ASSEMBLY

BACKGROUND OF THE INVENTION

1. Field of the Invention

The present invention relates to modular office screens for providing movable partitions for offices and the like. More particularly the invention relates to an improved construction of the interconnecting portions of modular office screens having a non-conspicuous, decorative appearance.

2. Description of the Prior Art

Various forms of detachable wall or screen partition systems are disclosed in the prior art and are used in commercial and residential environments. Examples of the mountable partition systems can be found in U.S. Pat. No. 3,766,606 and in U.S. Pat. No. 3,768,222. The background environment of the present invention and the status of the prior art can be readily ascertained from the U.S. Pat. No. 3,934,382 and from the references cited therein.

While the basic purpose and function of the modular office screen partition system is well known in the prior art, a designer in this field must realistically consider not only practical and economical aspects but the ornamental appearance of the assembled partition systems as well. For example it is desirable that the structure joining individual frames to provide a partition system of predetermined, demountable configuration be simple to manufacture and assemble, and provide a pleasing appearance with the entire partition assembly. Accordingly it is desirable to minimize or eliminate the number of structural components protruding from the outer surfaces of the frames containing the sound absorbing screens.

In light of the above there is a need in the prior art for an improvement in the structure joining the individual modular screens that meets the above described objectives.

SUMMARY OF THE INVENTION

It is an object of this invention to provide a movable modular screen assembly capable of forming predetermined partition configurations which is economical to manufacture and assemble.

It is another object of this invention to provide a movable modular screen assembly capable of forming predetermined partition configurations which exhibits no parts protruding from the assembled partition configuration and shows no uncovered corners or intersections and thereby creates a non-conspicuous, aesthetically pleasing appearance.

The above described and other objects and advantages are attained by a modular office screen assembly having a number of hollow rigid frame members each supporting a central panel member. Each frame member includes horizontal and vertical sections, and at a corner defined by the juncture of a horizontal and a vertical portion an aperture is provided in the horizontal section of the frame member. A support plate having an L shaped cross section is fastened inside each hollow rigid frame so as to define a vertically disposed elongated channel in the frame, and to support a base plate of a fastener member which is utilized for interconnecting two or more modular office screens at a predetermined partition configuration. A guide sleeve manufactured to higher tolerances than the frame members may be mounted within the vertical sections of each hollow frame; the guide sleeves and the support plates provide additional strength to the entire structure.

The configuration of the fastener members corresponds to the number of the modular screens interconnected by the same and to the predetermined configuration in which the modular screens are assembled. Each fastener member, however, has a base plate and at least two male channel members extending perpendicularly from the base plate. The shape and the dimensions of the base plate of the fastener members are designed to provide a contiguous surface with the outer surfaces of the assembled frames.

When assembling two or more modular screens in a predetermined partition configuration the male channel members of an appropriate fastener member are inserted into a respective aperture provided in each frame and the fastener member is pushed down until it is positioned flush to the horizontal section of each frame.

In order to eliminate a non-aesthetic appearance of discontinuity at the juncture of two or three modular screens when these are assembled in other than a straight line configuration a decorative panel is attached to a hook shaped piece rigidly fastened to a same side of the base plate of the appropriate fastener member where the male channel members are mounted. The decorative panel is also engaged in a dove-tailed portion mounted to the inside thereof by a tongue extending from a bottom fastener member.

The object and features of the present invention are set forth with particularity in the appended claims. The invention may be best understood by reference to the following description, taken in connection with the accompanying drawings.

BRIEF DESCRIPTION OF THE DRAWINGS

FIG. 5 is a perspective, partially exploded view of two modular screens interconnected at a 90° angle, and FIG. 6 is a perspective view of three modular screens of the present invention interconnected in a T configuration.

DESCRIPTION OF THE PREFERRED EMBODIMENTS

The following specification taken in conjunction with the drawings set forth the preferred embodiment of the present invention in such a manner that any person skilled in the modular screen manufacturing arts can use the invention. The embodiments of the invention disclosed herein represent the best mode contemplated by the inventor for carrying out his invention in a commercial environment, although it should be understood that various modifications can be accomplished within the parameters of the present invention.

Figure 1:
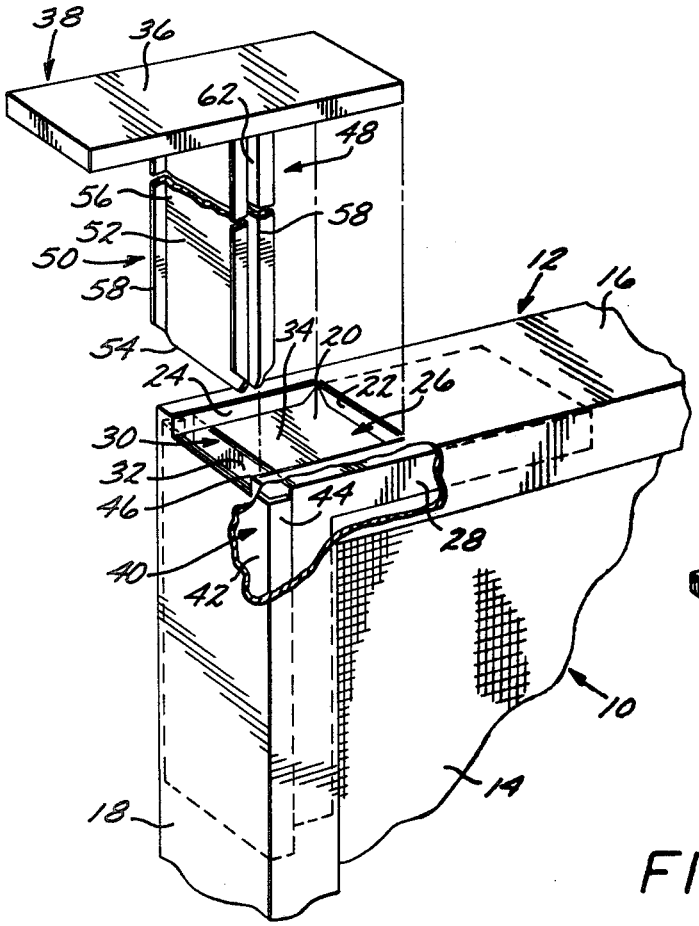
FIG. 1 is a partial perspective view of a modular screen and of a fastener member of the present invention with parts of the frame of the modular screen broken away.

Referring to FIGS. 1, 5 and 6 a modular screen 10 comprising a hollow rigid frame 12 and a central sound absorbing panel 14, is disclosed. The hollow rigid frame 12 is built from two parallel vertical and two parallel horizontal sections with only a portion of each of those sections being shown in FIG. 1. Both the horizontal sections 16 and the vertical sections 18 of the frame 12 comprise substantially U shaped metal channel members defining an inner open face into which a central panel member 14 is mounted. The central panel member may consist of a rigid or semi-rigid, transparent or opaque material such as glass fiber pad, or a plastic foam pad enclosed in a suitable fabric according to established practice in the art.

A substantially rectangularly shaped aperture 20 is provided in the horizontal section 16 of the frame 12 at a juncture defined by the horizontal 16 and the vertical sections 18 rigidly and permanently mounted together. The rectangular aperture 20 is disposed with one side thereof coinciding with the vertical section 18 of the frame 12. A side parallel to the side which coincides with the vertical section 18, is defined by a downward protruding lip portion 22 of the horizontal section 16. The other two parallel sides defining the aperture are likewise formed by downward protruding lips 24 of the horizontal section 16 and are disposed parallel to a longitudinal axis defined by the same.

A support plate 26 having an L shaped cross section is mounted by spot welding a lip portion 28 thereof within both the horizontal 16 and vertical 18 sections of the hollow, rigid frame 12. The lip portions 28 of the support plate 26 comprise two parallel sections, one such section being located on either side of the L shaped support plate, each lip portion being orthogonal to a main body 30 of the support plate 26. As the L shaped support plate 26 is rigidly fastened within the frame 12 at the juncture of the horizontal 16 and vertical sections 18 thereof, it is disposed below the rectangular aperture 20 which is partially surrounded by the downwardly protruding lips 22, 24 of the horizontal section 16. The support plate 26 further defines an elongated vertical channel 32 within the vertical section 18 of the frame 12.

An important feature of the present invention is that the distance at which a horizontally mounted portion 34 of the L shaped support plate 26 lies below the outer periphery of the horizontal section 16 of the frame 12 equals the thickness of a base plate 36 comprising part of a fastener member 38, also shown in FIG. 1. The purpose and the importance of this particular spatial arrangement will be understood as the mounting of the fastener member 38 to the rigid frame 12 is explained below.

A guide sleeve 40 is mounted within the vertical section 18 of the frame 12. The guide sleeve 40, like the frame member 12 itself has a substantially U shaped cross section and therefore comprises a base plate 42 and two parallel lip portions 44. As a convenient manufacturing technique the guide sleeve 40 is readily fastened to the vertical section 18 of the frame 12 by spot welding its base plate 42 and parallel lip portions 44 to the vertical section 18. Accordingly the vertical channel 32 disposed in the frame 12 is defined by the guide sleeve 40 and by a vertically mounted section 46 of the support plate 26.

It is to be noted that while both the guide sleeve 40 and the support plate 26 are fastened to the respective sections of the frame 12 by spot welding, other suitable means of fastening may be readily apparent to those skilled in the art and therefore the invention is not intended to be limited by this particular mode of fastening.

The purpose of incorporating the guide sleeve 40 in the vertical section 18 of the frame 12 is to provide additional strength to the assembled structure and to permit the utilization of a thinner gauge metal in the construction of the frame 12 than would be otherwise required. Furthermore the guide sleeve 40 may be manufactured to a higher degree of tolerance than the frame itself, and therefore by eliminating the need to manufacture the entire frame 12 to a similar high degree of tolerance an economic advantage may be gained.

It is another feature of the present invention that while the hollow frame member 12 supporting the central sound absorbing panel 14 is constructed in a like manner regardless of the particular configuration in which the modular screen assembly will be utilized, the fastener members used for interconnecting the modular screens have different designs depending on the number of modular screens to be interconnected and on their desired configuration.

FIG. 1 discloses a fastener member 38 utilized for interconnecting two modular screens 10 in a straight line configuration. As briefly referred to above, the fastener member 38 disclosed in FIG. 1 comprises a rectangular base plate 36 and two male channel members 48 and 50. The male channel members 48 and 50, in this as well as in other preferred embodiments, each include an elongated plate 52. The elongated plate 52 has a pair of parallel shorter sides 54 and a pair of parallel longer sides 56. It is rigidly mounted by welding or by some other suitable means on a shorter side 54 thereof to the base plate 36 of the fastener member 38. The pair of parallel longer sides 56 of the elongated plate 52 is rimmed by flanges 58 which provide additional strength to the male channel members 48, 50.

In this preferred embodiment of the fastener member 38 which provides for interconnecting of two modular screens 10 in a straight line configuration, the male channel members 48 and 50 are disposed parallel to each other, both being perpendicular to the base plate 36 of the fastener member 38. The distance 62 between the two male channel members 48 and 50 is designed to allow the interconnection of two modular screens 10 (only one of which is shown in FIG. 1) in a straight line with no open space left between the interconnected screens 10. This distance 62 also corresponds to a distance required by various structural members of a lower fastener member utilized for interconnecting the modular screens 10 at respective lower portions thereof. The portions of the frame 12 adapted to receive the lower fastener member and the construction of the lower fastener members is disclosed in U.S. Pat. No. 3,934,382 the specification of which is hereby expressly incorporated in this disclosure by reference.

When assembling two modular screens 10 in a straight line configuration, the two modular screens are fastened together at the respective lower portions thereof. Thereafter the male channel members 48 and 50 respectively, are simply inserted into the vertically disclosed channels 32 located in the frame 12 of each modular screen 10. The fastener member 38 is then pushed in a downwardly direction until its base plate 36 is snappingly received and held by the downwardly protruding lips 22 and 24 of the horizontal section 16 of the rigid frame 12. As briefly mentioned above, the base plate 36 of the fastener member 38 is so dimensioned that when it is fully inserted into the frames 12, the lower periphery of the base plate 36 is supported by a horizontally disposed section 34 of the support plate 26 and the outer periphery of the base plate 36 lies flush with the horizontal section 16 of the frame 12 thereby providing a smooth, aesthetically pleasing appearance and having no portion protruding from the frame 12.

Figure 2:
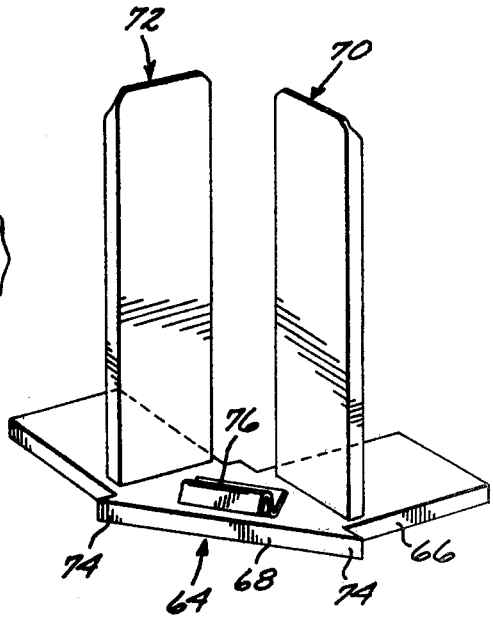
FIG. 2 is a perspective, inverted view of a fastener member of the present invention utilized for the interconnection of two modular screens at a 90° predetermined configuration.

FIG. 2 discloses an inverted fastener member 64 adapted for interconnecting two modular screens 10 at a right angle configuration, and the partially exploded view of FIG. 5 shows a pair of modular screens 10 connected together at a right angle. A base plate 66 of the fastener member 64 has substantially the shape of an angle iron with a corner cut away along a diagonal line 68. Two male channel members 70 and 72 each having a shape identical to the shape of the male channel members 48 and 50 described above, are welded to the base plate 66. In this preferred embodiment of the fastener member, however, the male channel members 70 and 72 are not only perpendicular to the base plate 66 but the planes defined by each male channel member 70 and 72 are also perpendicular to each other.

It is a feature of the present invention that the base plate of the fastener member utilized for interconnecting two or more modular screens at a configuration other than a straight line or a cross configuration, incorporates protruding portions 74 which are designed to become flush with the outer vertical periphery of the assembled screens 10. Thus the base plate 66 of the fastener member 64 is designed to be wholly accomodated within the assembled structure 10.

In order to further provide for non-conspicuous aesthetic appearance, this invention incorporates the following feature whereby the spatial discontinuity at a juncture of two or three modular screens interconnected in other than a straight line configuration is effectively covered. A hook shaped piece 76 is welded to the base plate 66 on the same side thereof where the male channel members 70 and 72 are fastened to the base plate 66. The hook shaped member 76 is disposed with a longitudinal axis of the elongated hook shaped piece 76 being parallel with the diagonally cut-off edge 77 of the base plate 66.

Referring specifically to FIG. 5 the interconnection of two modular screens 10 at a right angle, the mounting of the fastener member 64, and the covering of the spatial discontinuity at the interconnection is disclosed. The two modular screens 10 are first attached in the respective lower portions thereof by a lower fastener member 78. Thereafter the fastener member 64 is inserted in the respective frames of the screens 10, and the fastener member 64 is pushed down until it is snappingly engaged by the surrounding lip portions 22 and 24 in each screen 10 and until the base plate 66 of the fastener member 64 is supported by the respective support plates 26 in each frame 12. FIG. 5 clearly shows the assembled fastener member 64 being disposed flush both to the horizontal and vertical peripheries of the assembled screens 10.

A decorative panel 80 is then attached to cover the space at the interconnection of the joined screens 10. The decorative panel 80 comprises an elongated plate 82 substantially identical in length to the height of the modular screen 10. The decorative panel 82 also incorporates folded lip portions 84 rimming the edges of the plate 82 except in the lower portion thereof which is to be in contact with the lower fastener member 78 in the assembled structure. Furthermore a dove-tailed plate 86 is fastened by welding or by some other suitable means to a lower part of the plate 82 of the decorative panel 80. When assembling the decorative panel 80 to the structure the dove-tailed plate 86 is engaged by a tongue 88 extending in an upwardly direction from the lower fastener member 78, thereafter an upper horizontally disposed section 90 of the folded lips 84 is engaged by the hook shaped piece 76 whereby the decorative panel 80 becomes removably attached to the assembled structure.

Figure 3:
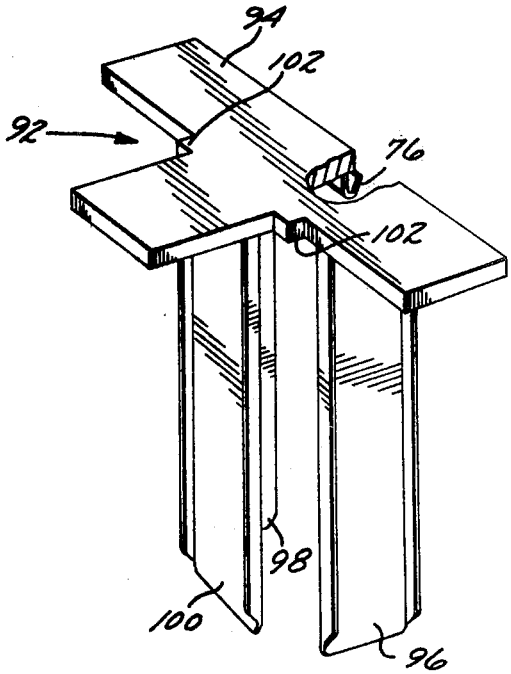
FIG. 3 is a perspective view of a fastener member of the present invention utilized for the interconnection of three modular screens at a predetermined T configuration with a part of a base plate of the fastener member being broken away.

FIG. 3 discloses a fastener member 92 adapted for interconnecting three modular screens 10 in a T configuration. The fastener member 92 has a substantially T shaped base plate 94. Three male channel members 96, 98 and 100 as well as a hook shaped piece 76 are fastened by welding or some other suitable method to a same surface of the fastener member 92. Each male channel member 96, 98 and 100 is identical in construction and design to the male channel members 48, 50, 70 and 72 described above in the other preferred embodiments, however, here two of the three male channel members 96 and 98 are disposed parallel to each other while the third male channel member 100 is mounted in a plane perpendicular to the planes defined by the former two male channel members 96 and 98. The two parallelly disposed male channel members 96 and 98 are designed to engage two modular screens 10 forming a straight line, while the third male channel member 100 is designed to engage the third modular screen disposed at a right angle to the former two screens.

The base plate 94 of the fastener member 92 is also provided with protruding portions 102 which are designed to be fully accomodated within the assembled partition configuration thereby again providing an aesthetically pleasing, flush, nonconspicuous appearance to the assembled structure.

When assembling the three modular screens 10 in order to form a T shaped partition configuration, the bottom portions of the respective frames 12 are joined together with a lower fastener member 104. Thereafter the respective male channel members 96, 98 and 100 are inserted into vertical channels 32 of the respective frames 12 of each modular screen 10 and the fastener member 92 is pushed down until engaged by the respective support plates 26 and lips 22 and 24 in each frame 12. Finally a decorative panel member 106 which is identical in design to the decorative panel 80 described above, is attached to the hook shaped piece 76 provided on the fastener member 92 and to a tongue (not shown) upwardly extending from the lower fastener member 104.

Figure 4:
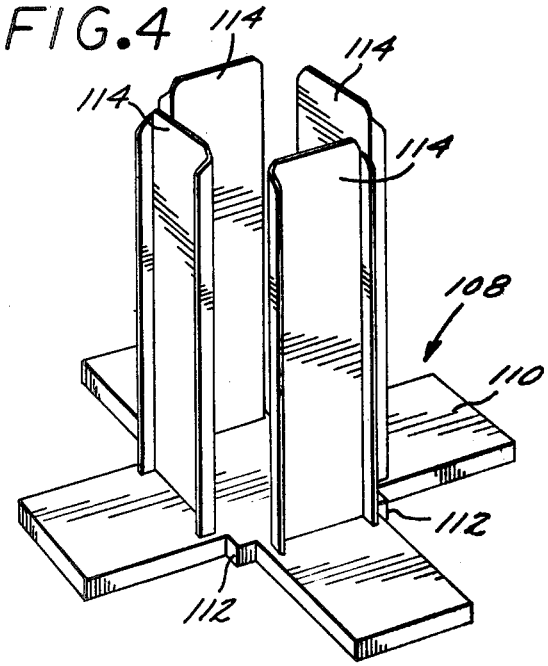
FIG. 4 is a perspective inverted view of a fastener member of the present invention utilized for the interconnection of four modular screens at right angles to each other.

FIG. 4 discloses a fastener member 108 utilized for the interconnection of four modular screens 10 at respective right angles to each other so as to form a cross configuration. A base plate 110 of this fastener member 108 is substantially cross shaped and has appropriate protruding portions 112 designed for full accomodation of the base plate 110 of the fastener member 108 within the assembled cross configuration of the modular screens 10. Four male channel members 114, each being identical in construction and design to the male channel members 48, 50, 70, 72, 96, 98 and 100 described above, are welded to a same surface of the base plate 110. The male channel members 114 are disposed in such a manner that an imaginary extension of the planes defined by their respective plates 52 form a square, with the respective parallel tabs 58 on each male channel member 114 facing outside of the square. In order to assemble a cross shaped partition configuration from four modular screens 10, all that is required is to assemble the lower portions thereof with an appropriate lower fastener member (not shown), and to insert the respective male channel members 114 of the fastener member 108 into the respective vertical channels 32 provided in each screen 10 and to push the fastener member 108 in a downwardly direction until its base plate 110 is engaged by the respective lips 22 and 24 and is supported by the respective support plates 26 provided in each modular screen 10.

What has been described above is a modular screen system capable of being assembled in a few steps and having an aesthetically pleasing decorative appearance. It will be apparent to those skilled in the art that various modifications of the present invention are possible and accordingly the scope of the present invention should be interpreted solely from the following claims.

What is claimed is:

1. In an improved modular office screen system having a plurality of hollow rigid frame members, each frame member supporting a central panel member, the improvement comprising:

a horizontal section of each frame member having an aperture which comprises an entry into a vertically disposed channel, at least one wall of the channel being formed by a support member mounted within the frame member;

a fastener member configured for mounting within the vertically disposed channel of at least one frame member through the aperture and for being held therein by friction and being completely removable therefrom, the fastener member presenting a contiguous planar surface with the outer horizontal periphery of the horizontal section of the frame member, the fastener member also having means for interconnecting the frame member with at least another frame member to form a predetermined partition configuration.

2. The invention of claim 1 wherein the fastener member further comprises a base plate and a male channel member, the male channel member being inserted into the vertical channel through the aperture.

3. The invention of claim 2 wherein the means for interconnecting the frame member with at least another frame members comprise a second male channel member attached to the base plate of the fastener member.

4. The invention of claim 3 wherein each hollow rigid frame member further comprises a vertical section, the vertical section being rigidly connected to the horizontal section, and wherein the support member comprises a support plate, the support plate being rigidly mounted in the vertical section of the hollow rigid frame member so as to define the vertically disposed channel therebetween, the male channel member fitting in the channel formed between the support plate and the vertical section.

5. The invention of claim 4 wherein the support plate has an orthogonal portion, the orthogonal portion being rigidly mounted in the horizontal section of the hollow rigid frame and being positioned in such a manner as to provide support for the base plate of the fastener member.

6. The invention of claim 5 wherein the horizontal section of each hollow rigid frame has a plurality of downwardly extending lip portions, the lip portions partially surrounding the aperture in the horizontal section and being positioned so as to snappingly engage and hold the base plate of the fastener member.

7. The invention of claim 6 wherein the male channel member has a pair of parallel flanges positioned on the edges of the male channel member.

8. An improved modular partition screen system comprising:

a plurality of hollow rigid frame members and a central panel member supported in each frame member, each frame member comprising at least a horizontal and a vertical section rigidly fastened together, each said section of the frame member comprising a substantially U shaped channel member with peripheral edge members parallel to its base surface and defining an open face, the horizontal section having an aperture;

a fastener member having a base plate and at least two male channel members fastened to and extending from the base plate, each of the male channel members being removably inserted into a respective aperture in the horizontal section of frame members whereby the frame members are interconnected, the base plate presenting a contiguous planar surface with the outer horizontal periphery of the horizontal section of each frame member, and a plurality of support plates having an L shaped vertical cross section, each support plate being rigidly mounted into the horizontal and vertical sections of a respective frame member so as to define a vertical channel in the vertical section of the frame member and to support the base plate of the fastener member, the male channel member being inserted into the vertical channel.

9. The invention of claim 8 wherein each support plate includes a pair of parallel ear portions extending at a 90° angle along the edges of the support plate, the ear portion fitting into a respective hollow frame member and being rigidly fastened thereto.

10. The invention of claim 9 wherein the horizontal section of each hollow rigid frame has a plurality of downwardly extending lip portions, the lip portions partially surrounding the aperture in the horizontal section and being positioned so as to snappingly engage and hold the base plate of the fastener member.

11. The invention of claim 10 wherein the improvement further comprises a plurality of guide sleeves having a U shaped cross section each guide sleeve fitting into and being rigidly fastened to a respective vertical hollow frame, each guide sleeve defining a wall of the respective aperture into which the male channel member is inserted.

12. In an improved modular office screen system, having at least two hollow rigid frame members, and at least two central panel members supported by the frames, each frame member comprising a horizontal and a vertical section rigidly fastened together, the horizontal section having an aperture, the frame members capable of being interconnected to each other to form a predetermined partition configuration having an angle other than 180°, the improvement comprising:

a fastener member having a base plate and at extending from the base plate, each of the male channel members being inserted into the aperture provided in the horizontal section of one of the frame members, the outer surface of the base plate being flush with the outer horizontal periphery of the horizontal sections of the frame members;

a decorative panel member;

means for removably fastening the decorative panel member to the fastener member so that the decorative panel member covers an opening created by and between the interconnection of the frame members defining the predetermined partition configuration;

a support plate included in each frame member, the support plate having an L shaped cross section and being rigidly mounted into the horizontal and vertical sections of the frame member so as to define a vertical channel in the vertical section of the frame member and to support the plate of the fastener member, one male channel member being inserted into the vertical channel, and.

a plurality of downwardly extending lip portions provided in the horizontal section of each frame member, the lip portions partially surrounding the aperture in the horizontal section and being positioned so as to snappingly engage and hold the base plate of the fastener member.

13. The improvement of claim 12 wherein the base plate of the fastener member has an extended portion immediately adjacent to each portion held by the downwardly extending lips of the horizontal section of each frame, the extended portions being flush with the outer vertical periphery of the frame members.

14. The improvement of claim 13 wherein the means for removably fastening the decorative panel member to the fastener member comprise a hook shaped member rigidly fastened to a lower surface of the base plate of the fastener member.

15. The improvement of claim 14 wherein the decorative panel member includes a dove-tailed member, and the improvement further comprises a bottom fastener member interconnecting the rigid frame members and having a tongue extending upward from the bottom fastener member, the dove-tailed member removably engaging the tongue.

* * * * *

UNITED STATES PATENT AND TRADEMARK OFFICE

CERTIFICATE OF CORRECTION

PATENT NO. : 4,185,430

DATED : January 29, 1980

INVENTOR(S) : Clifford W. Gartung

It is certified that error appears in the above—identified patent and that said Letters Patent is hereby corrected as shown below:

Column 8, line 67, after "at" and before "extending", insert --least two male channel members fastened to and--.

Signed and Sealed this

*Twenty-fourth* Day of *June 1980*

[SEAL]

*Attest:*

SIDNEY A. DIAMOND

*Attesting Officer*

*Commissioner of Patents and Trademarks*